US005966910A

United States Patent [19]

Ribani et al.

[11] Patent Number: 5,966,910

[45] Date of Patent: Oct. 19, 1999

[54] AUTOMATIC MACHINE FOR PACKAGING TABLETS IN GELATINE CAPSULES

[75] Inventors: Angiolino Ribani, Ozzano Emilia; Nerio Mirri, Imola; Marco Marescalchi, Ozzana Emilia; Aristide Cane' , San Lazzaro di Savena, all of Italy

[73] Assignee: I.M.A. Industria Macchine Automatiche S.p.A., Bologna, Italy

[21] Appl. No.: 08/945,663

[22] PCT Filed: May 8, 1996

[86] PCT No.: PCT/EP96/01926

§ 371 Date: Oct. 24, 1997

§ 102(e) Date: Oct. 24, 1997

[87] PCT Pub. No.: WO96/36307

PCT Pub. Date: Nov. 21, 1996

[30] Foreign Application Priority Data

May 19, 1995 [IT] Italy ..... B095A0239

[51] Int. Cl.[6] ..... B65B 47/00

[52] U.S. Cl. ..... 53/560; 53/253; 53/291; 53/900; 221/173

[58] Field of Search ..... 53/253, 454, 560, 53/526, 527, 529, 52, 498, 500, 291, 900; 198/400; 221/171, 172, 173

[56] References Cited

U.S. PATENT DOCUMENTS 4,940,499 7/1990 Lebrun et al. ..... 53/900
4,964,262 10/1990 Moser et al. ..... 53/900
5,018,335 5/1991 Yamamoto et al. ..... 53/900
5,369,940 12/1994 Soloman ..... 53/500
5,417,030 5/1995 Ribani et al. ..... 53/900
5,502,944 4/1996 Kraft et al. ..... 53/498
5,609,010 3/1997 Sauter ..... 53/454

*Primary Examiner*—James F. Coan
*Assistant Examiner*—Gene L. Kim
*Attorney, Agent, or Firm*—Larson & Taylor

[57] ABSTRACT

The machine includes groups of bushes (1) of dimensions suitable for the superposed and aligned containment of a base cover (14), of a tablet (52) and of a lid cover (14). By use of a moving device, the groups of bushes are brought into interaction in succession with (a) a station (5) which feeds into the bushes a base cover orientated with the mouth upwards, (b) a station (6) which feeds into the bushes, above the base cover, a tablet (52), (c) a station (7) which feeds into the bushes the lid cover orientated with the mouth downwards, (d) a station (8) which checks the correct presence or otherwise in the bushes of the base and lid covers with the interposed tablet and which signals any anomalies to the processor which controls the machine, (e) a station (9) which subjects the assembly of the base and lid covers and the interposed table to axial compression which is capable of making the tablet enter into the covers and become enclosed by these components, (f) a station (10) for ejecting the packaged tablets from the bushes, which sorts the defective product from that which is correctly packaged, and (g) a station (11) for cleaning the bushes.

19 Claims, 10 Drawing Sheets

AUTOMATIC MACHINE FOR PACKAGING TABLETS IN GELATINE CAPSULES

The invention relates to an automatic machine for packaging tablets in gelatine capsules. The covers which constitute the capsules are initially separate from one another and are located in bulk in respective stations of the machine which uses in part the concepts of European application EP-A-0 615 739 and to which the broadest reference is made. The machine is equipped with groups of bushes located on the periphery of a turntable or on a transfer which, with an intermittent movement, causes the same bushes to interact in succession with the following operating stations: a station which feeds into the bushes a bottom cover of the capsules, hereinafter called in short "base", orientated with the mouth upwards; a station which feeds the tablets into the bushes, above the base; a station which feeds into the bushes the closing cover of the capsules, hereinafter called in short "lid", orientated with the mouth downwards; a station which checks the correct presence in the bushes of the assembly of the base, of the tablet and of the lid and which signals any anomalies to a processor which controls the functioning of the machine; a station which subjects the assembly of the base, of the tablet and of the lid to a suitable compression in the axial direction to cause the tablet to enter into the base and into the lid and become enclosed in these two components; a station which takes care of the ejection from the bushes of the tablets enclosed in the gelatine capsules and which, on signalling from the presence checking station, is capable of sorting the correctly packaged product from that which is defective; a station which takes care of the cleaning of the bushes before these are to be introduced into a new work cycle.

Major characteristics of the invention, and the advantages which derive therefrom, will appear more clearly from the following description of a preferred embodiment of the same, illustrated purely by way of non-limiting example in the figures of the attached ten plates of drawings, in which.

Figure 1:
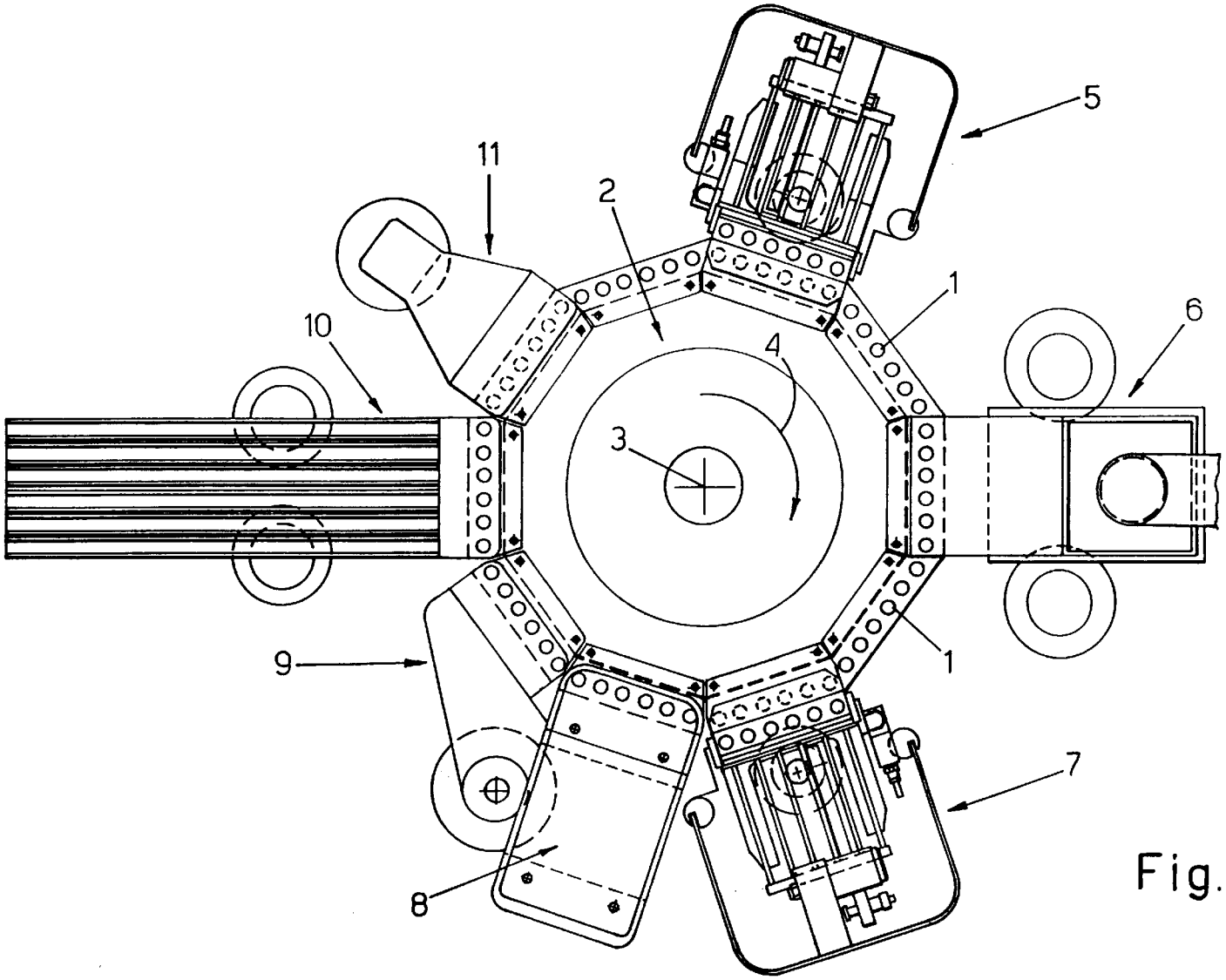
FIG. 1 is a diagrammatic plan view of the machine in the turntable version.

It can be seen from FIG. 1 that the machine comprises groups of bushes 1 for support of the covers of the capsules and of the tablets to be packaged, located in quantity and with an order which is predetermined and may also be different from that illustrated, on the periphery of a turntable 2 which, by suitable means, is made to rotate on command in an intermittent manner about its own vertical axis 3 and for example in the direction indicated by the arrow 4. According to a different embodiment, which also falls within the scope of protection of the invention, the groups of bushes 1 can be arranged on the rectilinear conveyor of a transfer system.

Following the intermittent movement to which they are subjected by the turntable or the transfer, the groups of bushes 1 are caused to interact in succession with the following operating stations: a station 5 which feeds into the bushes the base of the gelatine capsules; a station 6 which feeds into the bushes, above the base of the capsules, a respective oblong tablet; a station 7 which feeds into the bushes, above the tablet, the lid of the capsules; a station 8 which checks whether the base and the lid of the capsules are provided in the bushes with the tablet interposed and whether the whole has a height which falls within a predetermined and known condition or not; a station 9 which compresses the base/tablet/lid assembly axially in such a manner that the tablet becomes completely inserted and enclosed in the containing covers; a station 10 for ejection from the bushes of the tablets packaged in the gelatine capsules; a station 11 for cleaning the empty bushes before their introduction into a new working cycle.

Figure 2:
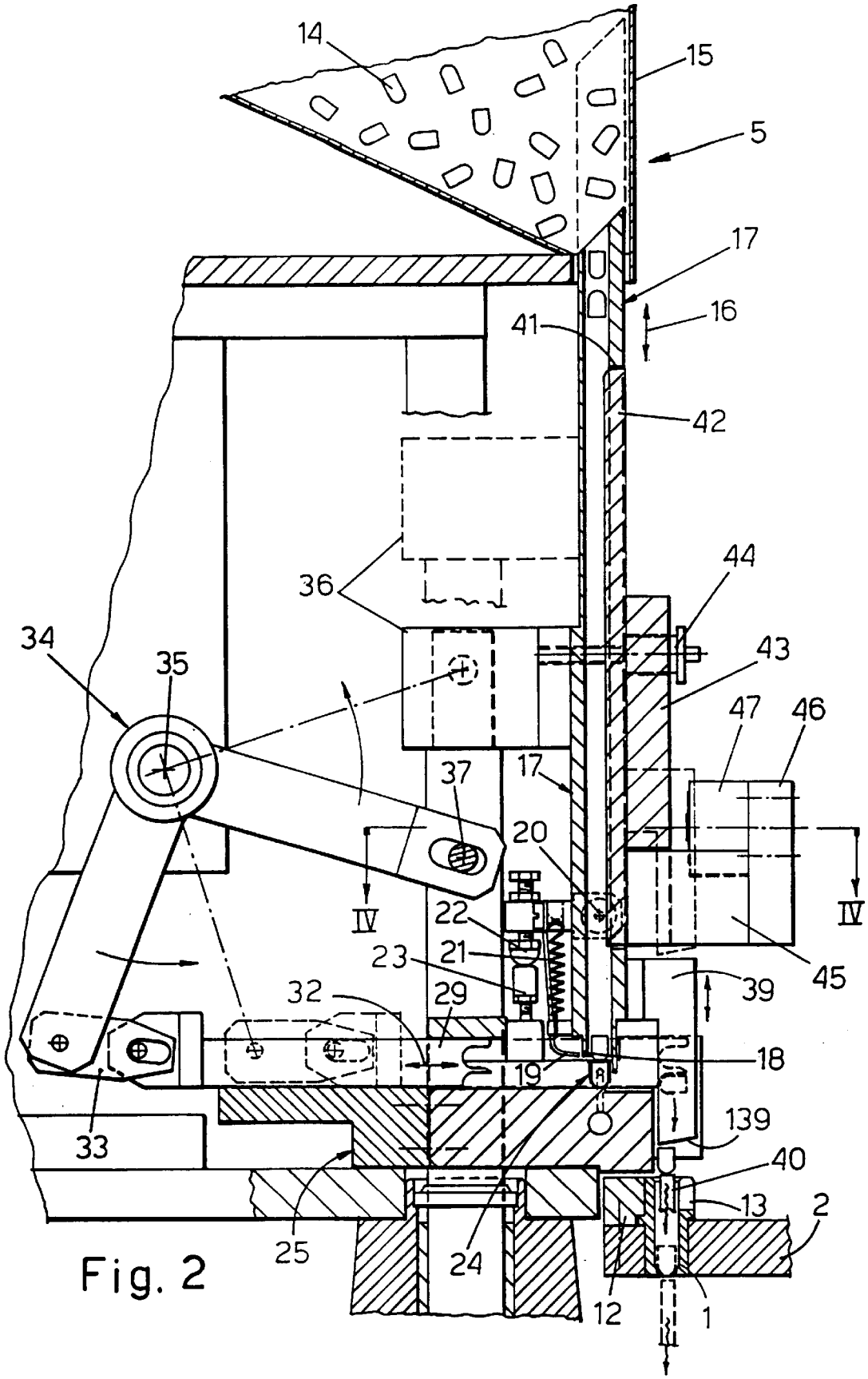
FIG. 2 is a lateral view with parts in section of the station which feeds the base of the capsules.

It can be seen from FIG. 2 that the bushes 1 define a vertical and cylindrical seat, of round section, which is tapered in the region of the lower end, flared at the upper end and of a height useful for containing in a superposed manner the base of the capsule, the tablet and the lid of the capsule itself. The bushes 1 are retained in place by a support 12 which faces towards the inside or towards the outside of the turntable and which can be removed rapidly for changing the bushes when the format of the product to be packaged is varied. The bushes 1 are lastly characterized by having on the length which projects above the support structure 2 and opposite the operating stations a vertical cut 13 which is useful for what is stated below.

The bases 14 of the gelatine capsules are located in bulk in a magazine 15 equipped with lower apertures passed through by a group of vertical and adjacent tubes 17 which are moved in turn in the axial direction by known means, as indicated by the arrow 16. The tubes 17 are cut with the upper end shaped like a flute mouthpiece and have an internal diameter which is slightly greater than the external diameter of the bases 14 so that these enter the tubes themselves in single file, in essentially axial alignment and with random orientation. Provided in the lower part of each tube is a lateral opening 18 which allows a stop 19 fulcrumed at 20 on the tube itself to be inserted under the line of bases guided in each tube, to retain them in the phase in which the tube itself rises. The stop 19 is pushed into the closing position by a spring 21 and is equipped with an endpiece 22 which, during the lowering of the tubes, interacts with a fixed striker 23 which brings about the opening of the same stop 19 and the consequent fall of the bottom base 14 of the tube into a vertical seat 24 which is formed in a fixed body 25 and is flared at the top and capable of 20 containing the base itself with slight play. The fall of the base into the seat 24 is guided by an endpiece 117 projecting from the lower part of the tube 17, which is arranged immediately downstream of the same seat 24 to form with the latter a virtually uniform guide, eliminating temporarily the corners which connect said seat to the orientation duct mentioned later. These means are for example similar to those described in U.S. Pat. No. 4,427,131 to which the broadest reference is made. The seat 24 communicates at the bottom, through a conical narrowing 27, with a blind and coaxial hole 26 of smaller diameter. The seat 24 is made with a symmetrical arrangement in the intermediate part of a horizontal duct 28 see also FIG. 9, the bottom of which is coplanar with that of said seat and the lateral walls of which are parallel to one another. The length of duct 28' located upstream of the seat 24 has a width which is smaller than that of the same seat and in it a flat horizontal pusher 29 is guided and slides longitudinally, equipped on the face facing the same seat 24 with a pair of points 30 and 31, the first of which is orientated roughly in the direction of the intermediate part of the seat 24 while the other is located above and at a distance from the first which is roughly equal to the width of the base 14. The points 30, 31 have a length which is equal to or expediently greater than half the height of the base 14.

The pusher 29 is actuated with reciprocating movement, as indicated by the arrow 32, by the same means which cyclically raise and lower the group of tubes 17, for example by a connecting rod 33 connected to the angled lever 34 fulcrumed at 35 which is made to oscillate about said fulcrum by suitable means. 36 indicates the vertically movable slide which is connected at 37 to said lever 34 and on which the group of tubes 17 is mounted.

The length 28" of the duct 28 located downstream of the seat 24 has a width which is slightly less than the external width of the base 14 so that the latter can slide with friction in said length of duct. The bottom 38 of the length 28" of duct is expediently lowered in relation to that of the length 28' of the same duct. The length 28" of duct communicates with the end of a vertical, descending duct 28'", of equal width, which is also formed in said body 25 and is expediently widened in the lower end length. Fixed laterally to each tube 17 is a flat pusher 39 with the lower edge 139 expediently inclined so as to form a slight tip from the part facing towards the same tube, and which has dimensions so as to be capable of sliding in said duct 28'", passing from the rest position indicated in FIG. 2 by broken lines, which sees said pusher raised outside said duct, to the lowered position indicated in solid lines, in which the pusher engages in the duct 28'" and reaches with its own lower end 139 into the widened end part of this duct.

In the phase of feeding a base to the bushes 1, these are aligned in the lower part of each duct 28'", and located below each bush is a vertical push rod 40, of known type, connected to a source of suction and mounted on means of axial movement.

Figure 7:
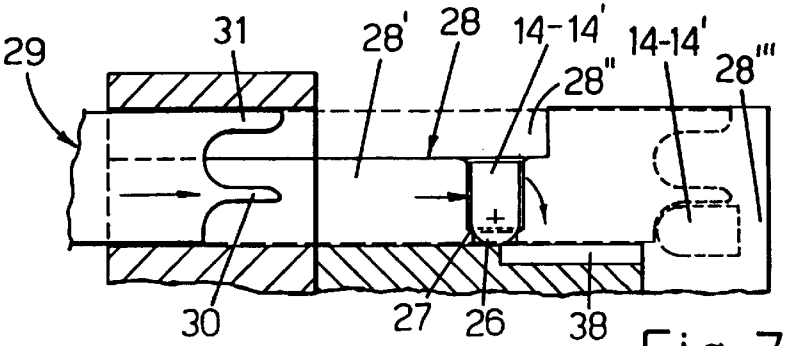
FIGS. 7 and 8 illustrate a further, enlarged detail of the station in FIG. 2 and demonstrate the different manner of operating the orientation device.
Figure 8:
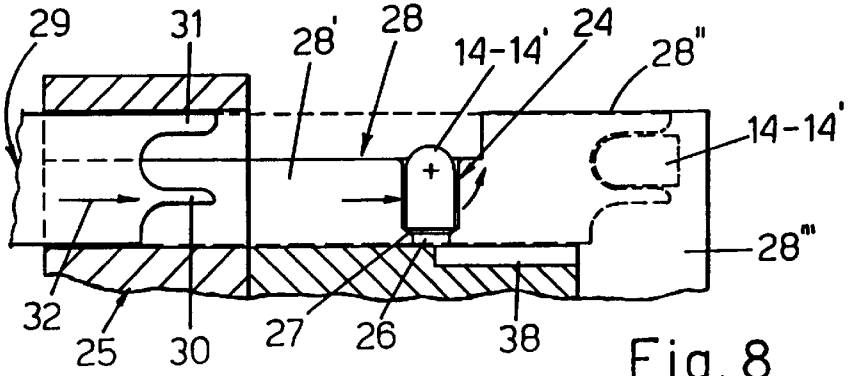

In the descending movement of the tube 17, a base 14 enters by the effect of gravity into the seat 24, in which it may be orientated with the rounded head towards the bottom or towards the top, as illustrated in FIGS. 7 and 8. In the successive phase, while the tubes 17 are raised to be resupplied with new bases from the magazine 15, with the stop 19 in the closed position, the pusher 29 moves to the right looking at FIGS. 7 and 8 and passes from the position indicated in solid lines to that indicated in broken lines. The point 30 of the pusher comes into contact with the intermediate part of the base 14 located in the seat 24 and pushes the base itself into the duct part 28". Entering this duct, the base encounters a greater friction with the part of itself which is close to the closed end and which, unlike the open end, has reduced possibilities of flexion and of deformation. The result is that, during the movement by the point 30, the base 14 enters the duct 28" rotating about its own closed end and arranging itself with the mouth in front, whatever the orientation with which the same base initially arrives in the seat 24. More specifically, the base is arranged below the point 30 if it was orientated with the closed part at the bottom, as can be seen in FIG. 7, while it is arranged above the point 30 and below that 31 for containing if its closed end was facing upwards, as can be seen in FIG. 8. The closed end of the base touches the expediently rounded front face of the pusher 29 which moves the base itself along the duct 28" and transfers it into the top part of the descending duct 28'" where the same base remains by effect of friction and in an essentially horizontal position while the same pusher returns into the rest position. During this same phase, while the tube 17 descends to feed a new base into the seat 24, the pusher 39 descends and, with its own lower end 139, pushes downwards the base which was previously orientated and inserted into the top part of the duct 28'" and which is now orientated with the closed end at the bottom and which, when it arrives in the lower and widened part of said duct, is taken by its own closed end by the push rod which has been raised through the bush 1 and is exerting suction. The push rod 40 is subsequently lowered to insert the base 14 into the bush 1, as indicated in broken lines, and then the same push rod returns into the rest position and stops exerting suction. The pusher 39 subsequently returns into the high position to carry out a new work cycle and the turntable 2 rotates clockwise to bring the group of bushes 1 with the bases 14 into alignment with the successive station 6.

With the exception of new frontal contouring of the pushers 29 and 39 and of a different contouring of the duct 28" which has been lowered in relation to the seat 24 so that the bases 14 have to rotate more easily towards the bottom when they are orientated downwards with their closed end (FIG. 7), in all other aspects the device in FIG. 2, as described thus far, refers essentially to what was envisaged in the European application EP-A-0 615 739 cited in the introduction, from which it differs further, however, in the following two improvements which have proved to be decisive for the functioning of the device itself.

Figure 4:
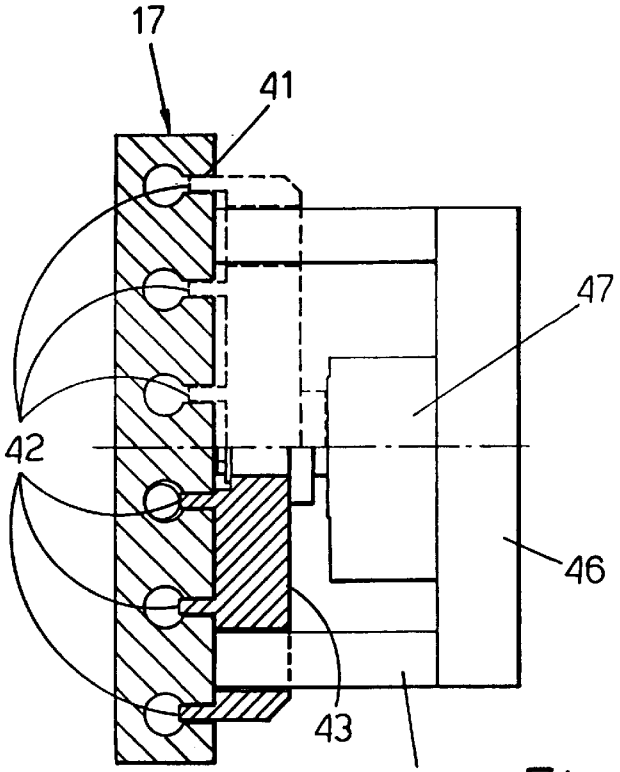
FIG. 4 illustrates further details of the station in FIG. 2, sectioned along line IV—IV.
Figure 3:
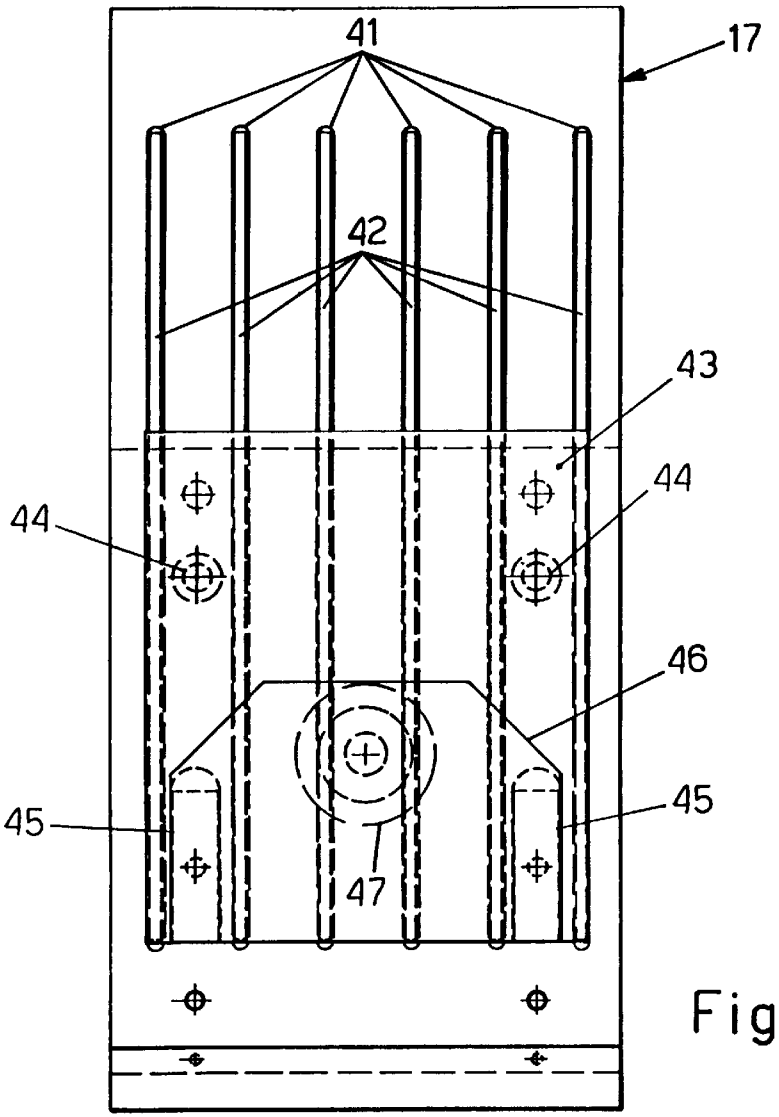
FIG. 3 is a view in frontal elevation of the intermediate part of the station in FIG. 2.

In travelling through the tubes 17, as a result of the greater diameter of these, because they are pushed by effect of gravity alone and because they are of limited weight, the bases 14 may adopt an inclined position and may not slide and become jammed. To eliminate this disadvantage, as illustrated in FIGS. 2, 3 and 4, all the tubes are provided with longitudinal and continuous slots 41, in a number of one per tube, and in these slots, respective rectilinear blades 42 are engaged which are integral with a common structure 43 which slides guided on the means 44 which fix the set of tubes to the slide 36 and on a pair of lower guides 45 fixed perpendicularly to said set and on the free end of which there is fixed a crosspiece 46 which bears the body of a small actuator 47, for example of pneumatic or electromagnetic type, connected with its own moving equipment to said structure 43, so as to subject the latter and the set of blades to a small reciprocating horizontal movement. Through the effect of this movement, the blades 42 enter and exit from the internal seat of the tubes, as indicated in FIG. 4 with solid lines and with broken lines, subjecting the line of bases which engage in the tubes themselves to a forced alignment and to a fluidification which guarantees their sliding by effect of gravity in the same tubes.

Figure 6:
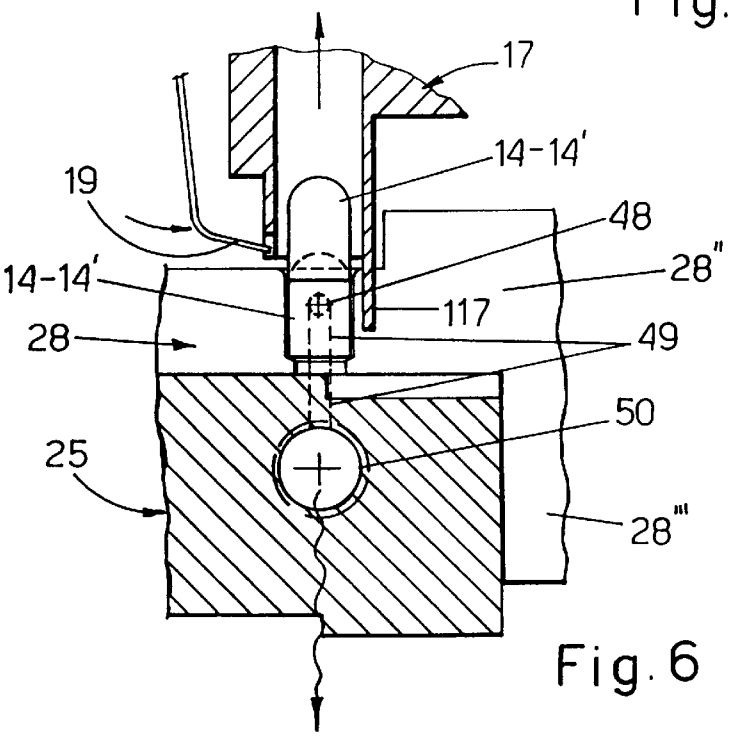
FIGS. 5 and 6 illustrate an enlarged detail of the station in FIG. 2, with the different arrangement with which the bases of the capsules can arrive in the seat of the orientation device.
Figure 5:
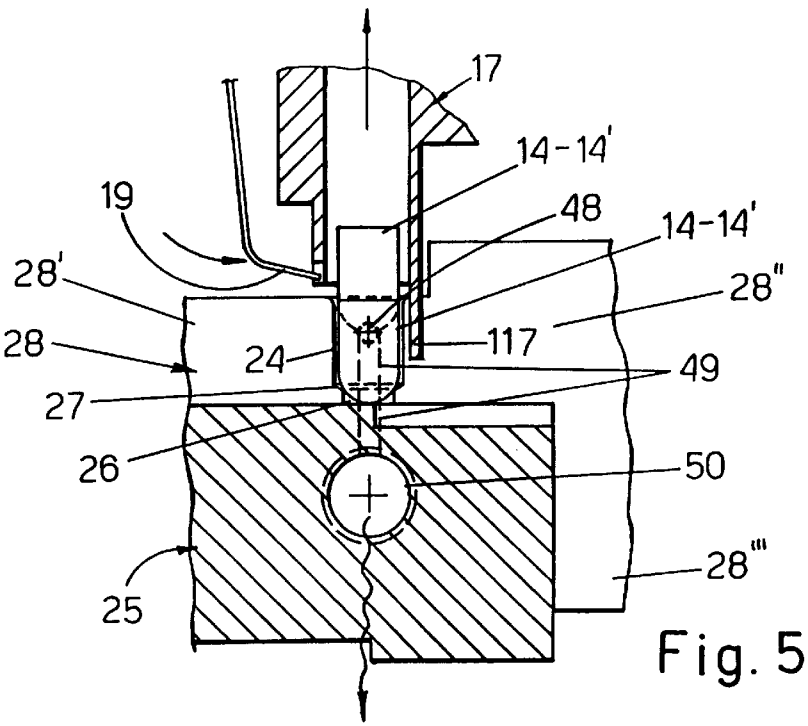

Another operating disadvantage came about when the bases 14 of the capsules arrived in the seat 24 with the same orientation as the following base and when, because of this orientation, the two successive bases were mutually nested as illustrated in the examples in FIGS. 5 and 6. In this case, when the tubes 17 were raised and the stop 19 intervened to retain the penultimate base, the last base, which was extracted from the seat 24 into which it had previously entered by the effect of gravity, remained anchored to it. To eliminate this disadvantage, there have been opened, on at least one side of each seat 24, respective horizontal holes 48 which communicate through the same number of vertical holes 49 with a single horizontal hole 50 made, with the function of manifold, in the body 25 and connected by one end to a pipe 51 which, by means which are not shown, can be connected on command to a source of suction. After the tubes 17 have descended and a base 14 has entered into the seats 24, the holes 48 are connected automatically to the suction to retain the base 14 in said seats, even if it is nested with the one above which, blocked by the stop 19, will follow alone the tube 17 in the reascending movement.

Figure 9:
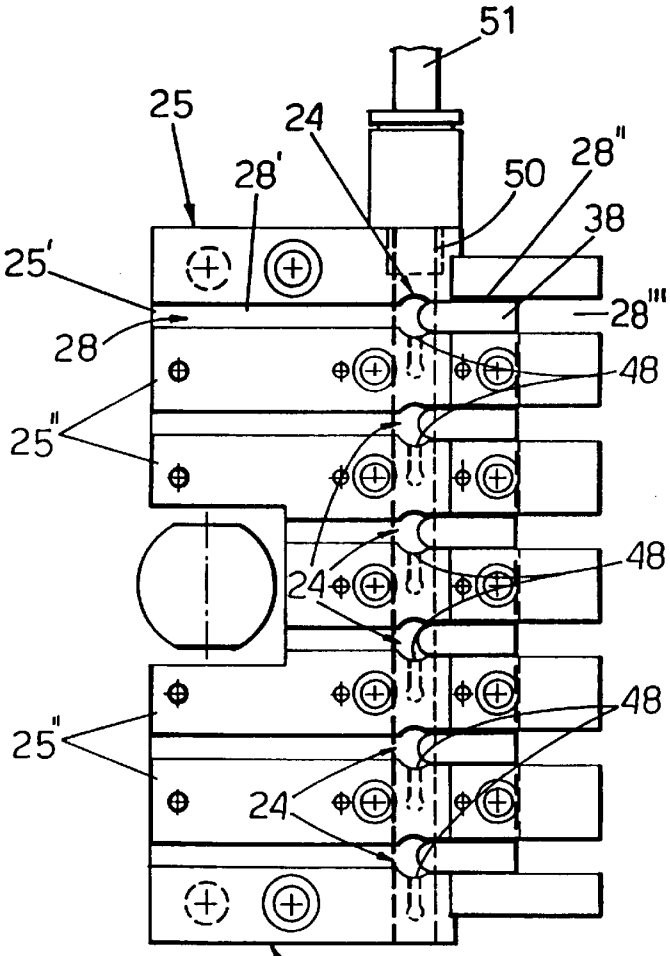
FIG. 9 is a plan view from above of the seats of the orientation device of the station in FIG. 2.

It can be seen from FIG. 9 that the body 25 is preferably constituted by a lower piece 25' which bears integrally the parts defining the bottom of the ducts and on which the parts 25" which define the lateral walls of the same ducts and of the seats 24 are mounted and fixed. Formed in the bottom piece 25' is the manifold hole 50 which, through vertical holes 49, communicates with the horizontal holes 48 of said parts 25" (see also FIG. 5).

Figure 13:
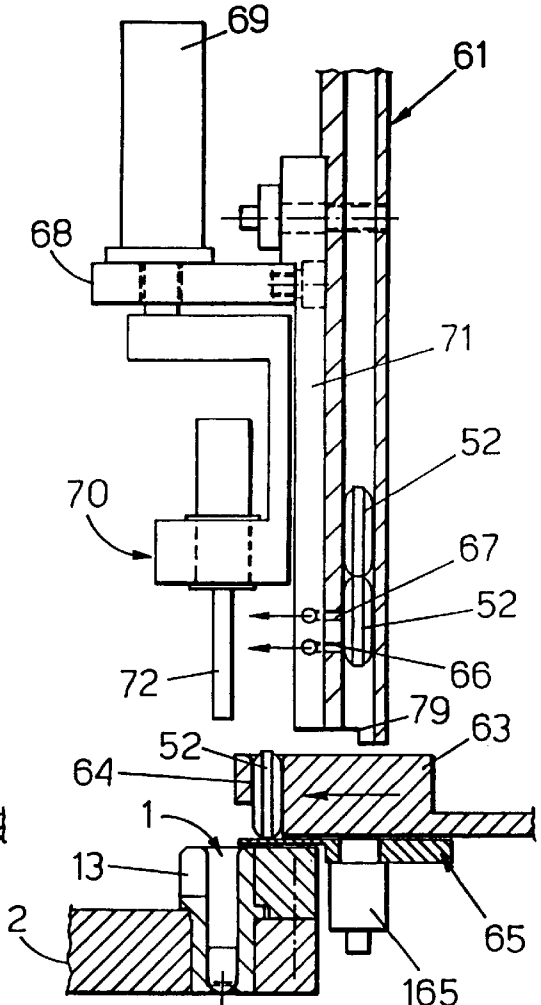
FIGS. 11, 12, 13, 14, 15 and 16 are lateral views with parts in section of the end structure of the station in FIG. 10, depicted in the same number of work phases.
Figure 12:
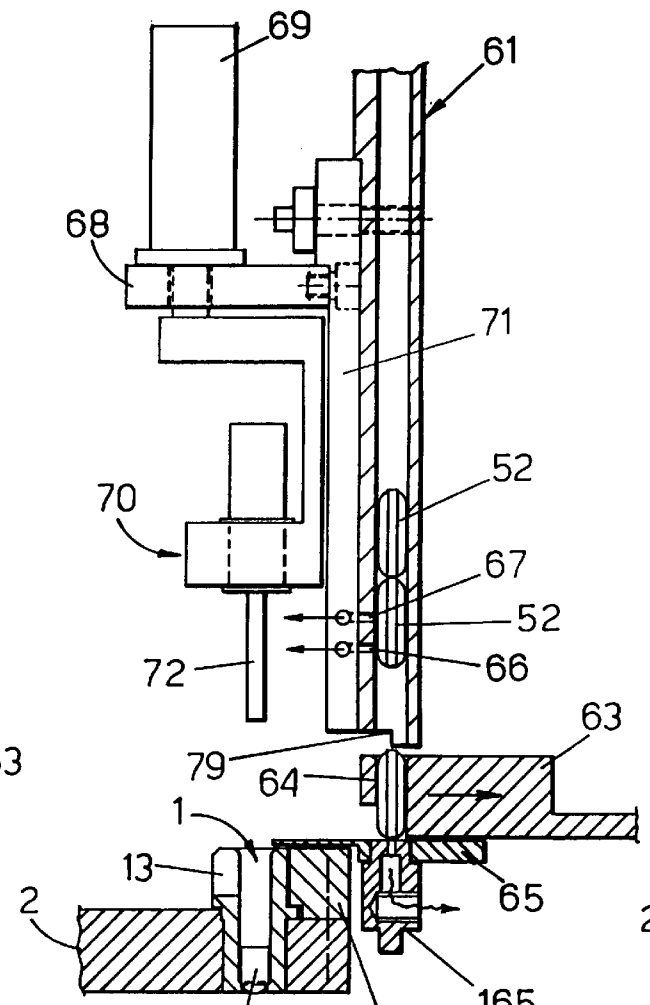
Figure 14:
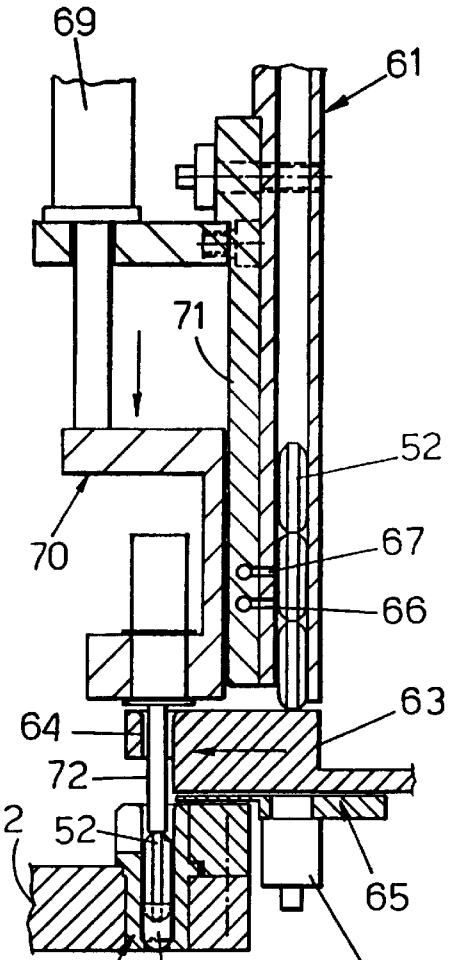

When the feeding of the base 14 into the bushes 1 has taken place, the turntable 2 rotates and brings the same bushes into interaction with the successive station 6 for feeding the tablets, which will now be described with reference to FIGS. 10 and 11. The tablets 52 are located in bulk in a container 53 and, by means of a vibrating hopper 54, are fed into the chamber 55 located on the top end of a horizontal guide 56 which is supported by the support 57, subjected to vibrations by suitable means (not shown) and equipped with a plurality of longitudinal channels 58 with a suitable contour, in which the tablets 52 slide in single file. The front wall 155 of the chamber 55 serves as leveller and can if necessary be adjusted in height so that the tablets leave the chamber itself aligned longitudinally only in the channels 58 and one following another. Overflow sensors 59, for example photocells, operate in the chamber 55, which sensors control the functioning of the hopper 54. The tablets transported by the channels 58 are transported by means of the curved guides 60 into vertical guides 61 which are fixed to the support structure 62 and below which, as illustrated in FIG. 11, a distributor drawer 63 is movable horizontally, with vertical seats 64 in a number equal to the number of guides 61 and of a height which is essentially equal to or slightly shorter than the length of a tablet. Provided below the drawer is a fixed obturator 65 with a suction plug 165 which is open vertically upwards and about which more will be said below. The bushes 1 are arranged with their cavity which contains the base 14 of the capsules in the region of the end part of the obturator 65 and at a suitable distance from the vertical guides 61 which are equipped with pairs of holes 66 and 67 which can be connected on command to a source of suction (not shown). The distance between the lower hole 66 and the top of the drawer 63 is expediently greater than the length of a tablet and smaller than one and a half times the length of the same tablet, while the distance between the upper hole 67 and the top of the drawer is roughly equal to one and a half times the length of the same tablet. When the seats 64 of the drawer 63 are moved away from the guides 61 and the bottom tablet 52 rests on the top of the same drawer, the penultimate tablet is located with its own lower end and with its own intermediate part in the region of the holes 66, 67 which are actuated and retain it by suction when the same drawer starts to translate towards the right looking at FIG. 11, so that when the seats 64 arrive in alignment with the guides 61, only the last tablet descends and, by the effect of gravity, engages in said seats, as illustrated in FIG. 12. The tablet which engages in each seat 64 is, with its own upper end, outside the guides 61 so as not to interfere with these when the drawer 63 translates towards the left looking at FIG. 13 until arriving with the seats 64 in alignment with the bushes 1 where it discharges by the effect of gravity the translated tablets 52 as illustrated in FIG. 14.

From FIG. 12, it appears clear that the suction plug 165 avoids the rebound of the capsule which cyclically falls into the seat 64 of the drawer 63, keeping it correctly arranged in this seat. If particular maintenance requirements then so require, it is possible to remove the plug 165 and empty the tube 17 above.

Figure 10:
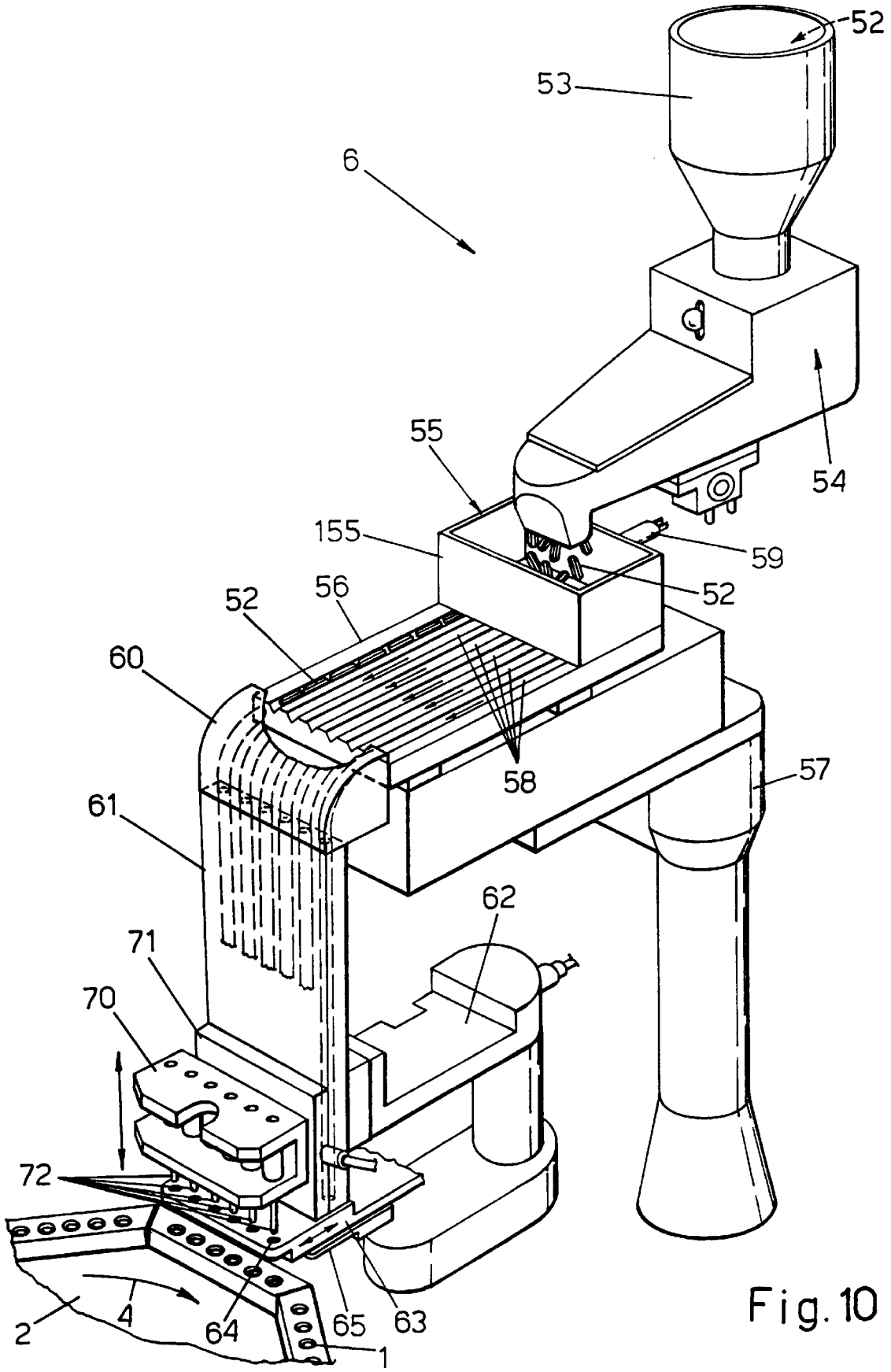
FIG. 10 is a diagrammatic view in perspective of the station for feeding the tablets.
Figure 11:
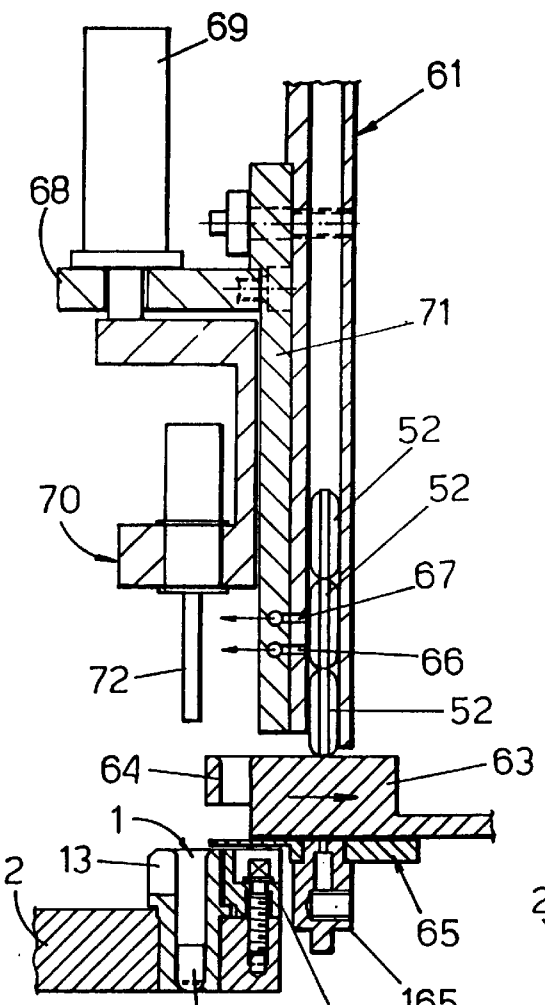
Figure 16:
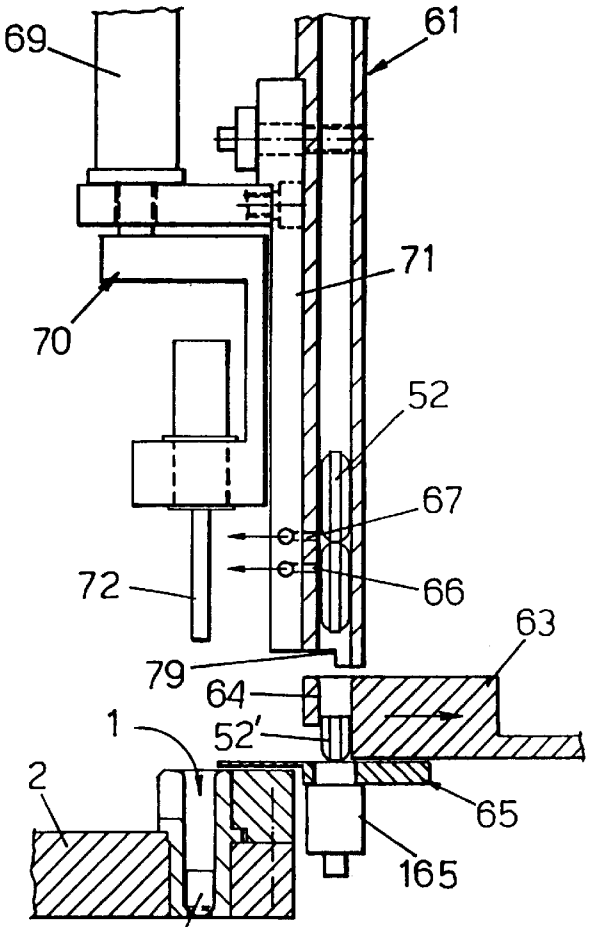

From FIGS. 10 and 11, it can be seen that a bracket 68 is fixed in a cantilevered manner on the structure of the vertical guides 61, which bracket bears at least one actuator 69 connected with its own moving equipment to a slide 70 which slides on the vertical and fixed guide 71, which has a "C" shape and which with the lower wing bears vertical pushers 72, in a number of one for each bush 1, aligned axially with the same bushes. At the start of each cycle, the slide 70 is raised and the pushers 72 are positioned so as not to interfere with the drawer 63. When the drawer has inserted a tablet in the bushes 1, as illustrated in FIG. 14, the slide 70 is made to descend and the pushers 72 push the tablet 52 and insert it partially into the base 14. In the successive phase, the slide 70 is raised and the turntable 2 rotates to bring the bushes 1 into interaction with the successive station 7.

Figure 15:
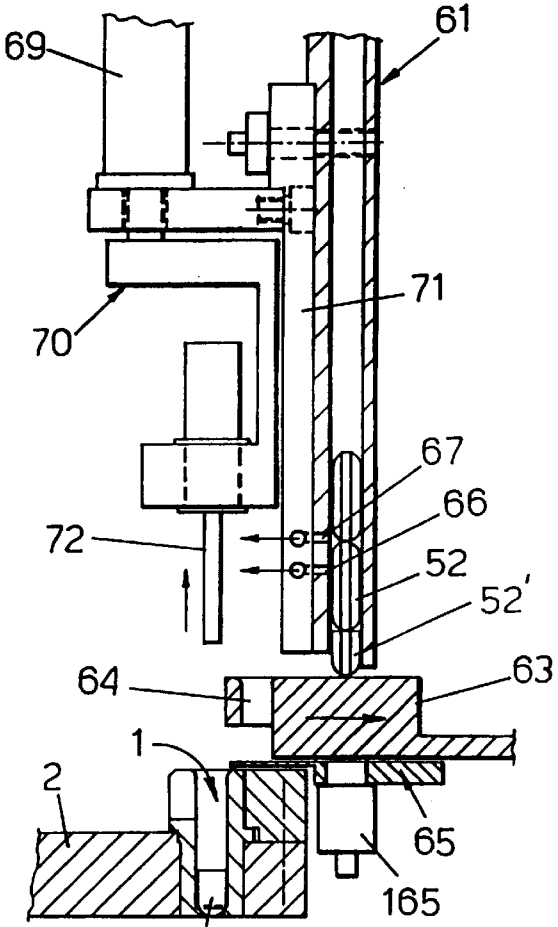

From FIG. 15, it can be seen that if a portion of tablet 52' were present in a guide 61, when this touches the top of the drawer 63, the complete tablet 52 above is arranged with its own intermediate portion in the region of the hole 66 which, when it is connected to the suction means, before the seats 64 of the drawer are aligned with the guides 61, retains in position the penultimate tablet while only the portion of tablet 52' falls into the seat 64. Without the presence of the suction holes 66, 67, the penultimate complete tablet would have fallen together with the portion, would have engaged only in part in the seat 64 and its upper projecting length would have interfered with the guide 61 during the successive translation of the drawer 63 and would inevitably have been sheared off with the imaginable consequences.

If a portion of tablet of a length smaller than half that of an entire tablet were to come into contact with the top of the drawer 63, as a result of which the tablet above could not be retained by the suction of the hole 66, both the portion and the entire tablet, which would project slightly from the seat 64 of the drawer, would be inserted into the same seat. To avoid this tablet being sheared off during the translation of the drawer, provision has been made for the lower end of the guides 61 to be equipped with a recess 79 on at least the side facing towards the bushes 1, so as to avoid interference of said projecting tablet with the guide 61.

Figure 17:
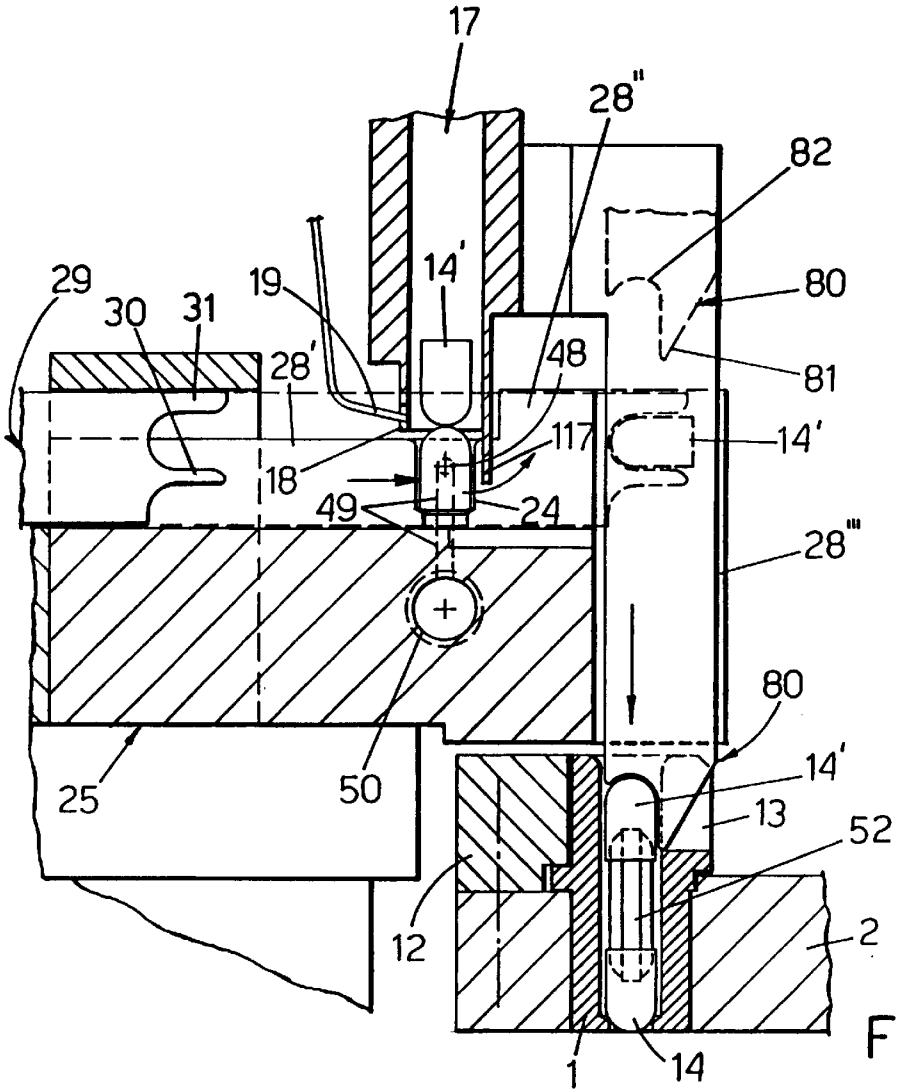
FIG. 17 illustrates laterally with parts in section the station for feeding the lids of the capsules.

The station 7 is entirely identical with that 5 already described, from which it differs in that the vertical pusher 80 as can be seen in FIG. 17 is equipped with a point 81 and with a recess 82 of known type which, in interfering with the lid 14' of the capsule, forces it to rotate with the mouth towards the bottom and to arrange itself with its axis vertical and insert it into the bush 1, above the tablet 52, engaging in part in the lateral cut 13 of the bush itself.

The machine according to the invention has been designed for inserting the tablet 52 in two identical covers made of hard gelatine which at the end of the cycle completely incorporate the tablet itself and abut one another frontally without partial superposition as is the case on the other hand with the normal gelatine capsules equipped with true base and lid covers. It is intended, however, that the machine can be adapted for packaging tablets in gelatine capsules of traditional type.

Figure 19:
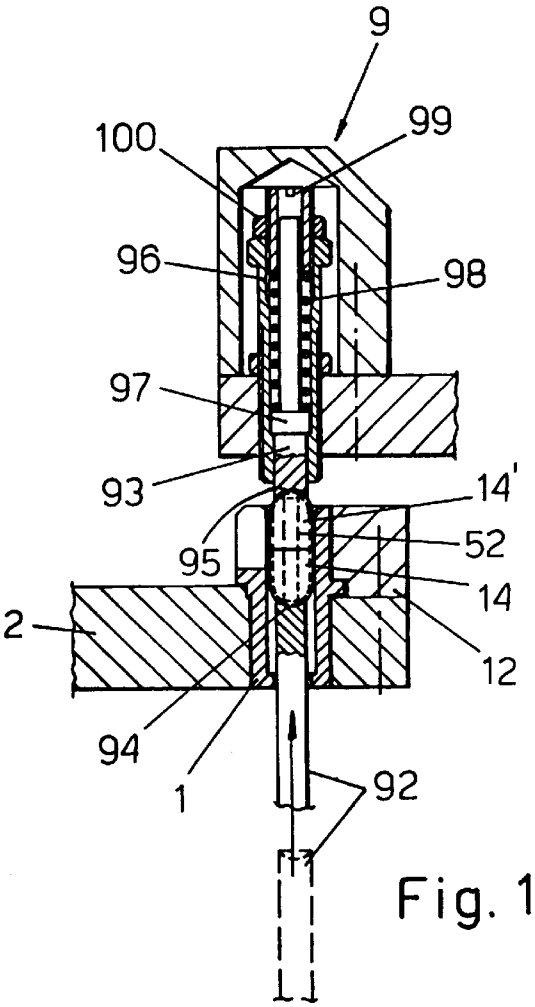
FIG. 19 illustrates laterally with parts in section and in the work position the station for inserting and enclosing the tablet in the base and in the lid of the capsule.
Figure 18:
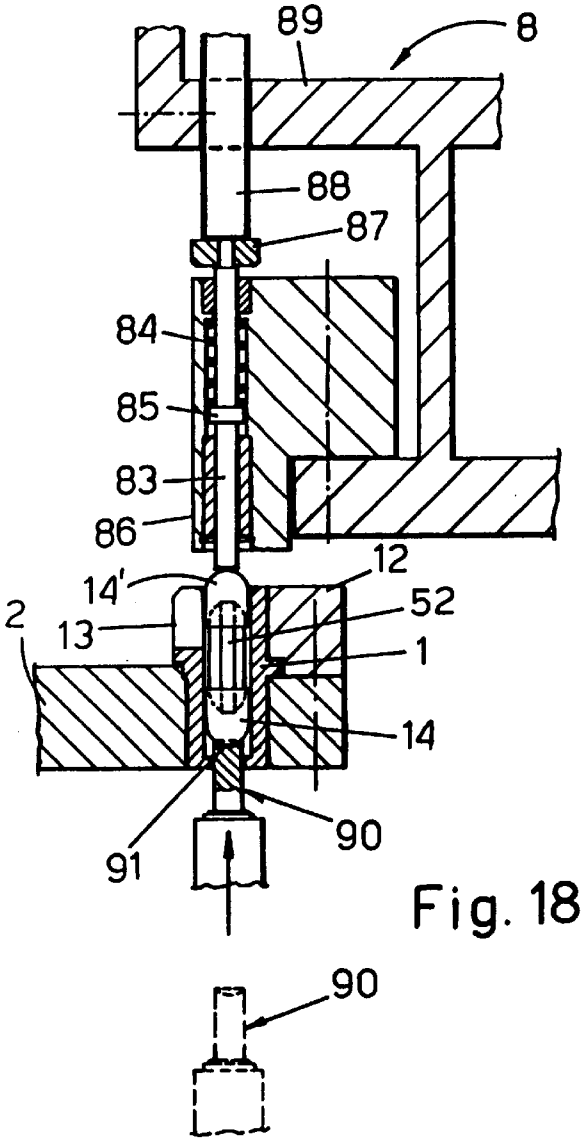
FIG. 18 illustrates laterally with parts in section and in the work position the station which detects the presence or absence in the support bushes of the base, of the lid and of the interposed tablet.

When insertion of the lid 14' into the bushes 1 has taken place, after which the pusher 80 is raised, the turntable 2 rotates one step and inserts the bushes 1 into station 8 which is illustrated in detail in FIG. 18. This station comprises vertical push rods 83 which are located in axial alignment with and above each bush 1 and which are normally pushed, by springs 84, with their collar 85 bearing against the lower end of their guide 86 and projecting a suitable length from this end of the guide. Fixed on the upper end of the push rods 83 are ferromagnetic heads 87 and provided at a suitable distance above these are proximity sensors 88 mounted on a fixed support structure 89. Arranged and aligned axially below the bushes 1 which arrive in station 8 are push rods 90 with a concave head 91 which are associated with means (not shown) of axial movement and which at rest are in the low position indicated in FIG. 18 in broken lines. On command, the push rods 90 are raised by a fixed travel, enter into the bushes 1 from the lower end and raise the assembly of the capsules and of the tablets 14, 52, 14' by a predetermined amount which brings about a predetermined raising of the upper push rods 83, which is detected by the sensors 88. If one of the components 14, 14', 52 were not present in the bushes 1, the push rods 83 would not be raised and the sensors 88 would detect that in the bush below assigned to these there exists an incomplete product which will have to be discharged in the final station 10. The push rods 90 are successively lowered, the unit 14, 14', 52 returns to ear on the bottom of the bushes 1 and is separated from the upper push rods 83 which also return into the low rest position, after which the turntable 2 rotates by one step to transfer the bushes 1 into station 9 where the means illustrated in detail in FIG. 19 operate. In this station, the bushes arrive in axial alignment with respective lower and upper push rods 92 and 93. The lower push rods have a concave head 94, are similar to those 90 already considered, are associated with means (not shown) of axial movement and at rest are in the position indicated by broken lines. The upper push rods 93 also have a lower concave head 95 and are mounted with the possibility of axial movement in respective fixed guides 96, against the lower end of which the same push rods are pushed to bear with their collar 97 by a spring 98 which can preferably be adjusted by means of the hollow plug 99 with locking nut 100. On command, the push rods 94 are raised, enter into the bushes 1 and raise the unit 14, 52, 14' which comes into contact with the upper push rod 93 so that, under the compression of the two push rods, the tablet 52 enters completely into the covers 14, 14' as illustrated in FIG. 18, while the whole remains in the bushes 1. Subsequently, the lower push rods 92 return into the low rest position and the packaged tablets are lowered into the bushes 1 and come out of interaction with the upper push rods 93 so that the turntable 2 can be rotated by one step for interaction with the discharge station 10.

Figure 20:
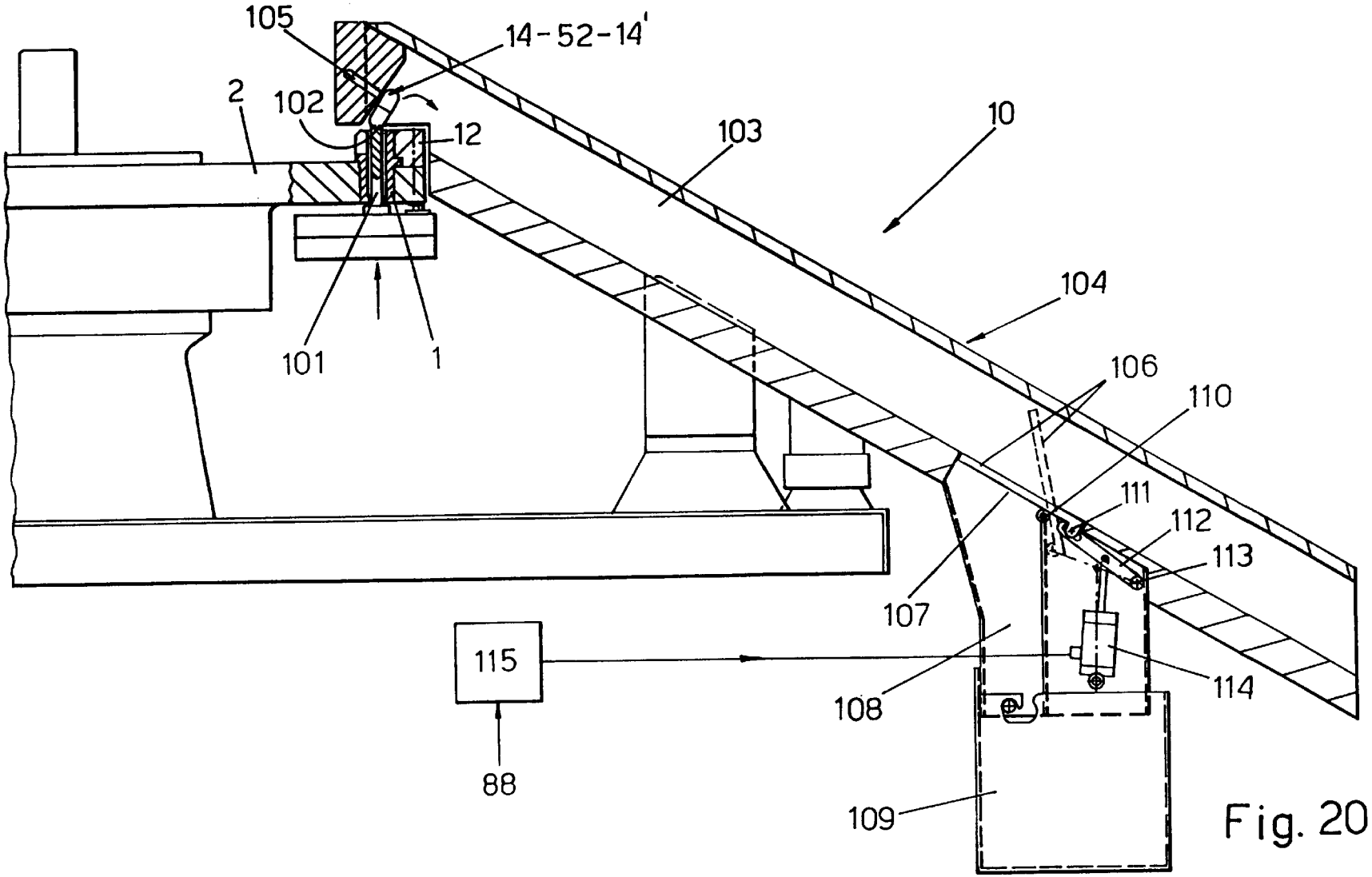
FIG. 20 illustrates laterally with parts in section and in the active condition the station for discharge of the packaged tablet by the support bushes.

In this station, as illustrated in FIG. 20, the bushes 1 arrive in axial alignment with the lower push rods 101 which have a preferably concave head 102 and are connected to actuating means in the same manner as those 92 of the preceding station and the same bushes 1 are arranged in the region of the initial part of each of the ducts 103 with which a fixed chute 104 is equipped longitudinally. On command, the push rods 101 enter the bushes 1 and raise the packaged tablets which leave the bushes themselves at the top and are pushed downwards by a jet of air delivered by nozzles 105. If the discharged product does not have imperfections, it is collected from the lower end of the chute 104. If, on the other hand, the product has imperfections, it is automatically eliminated by the raising of a door 106 which opens a lower and intermediate opening 107 of the duct, which communicates, through the pipe 108, with a removable collecting container 109. The door 106 is for example interfulcrumed at 110 and is connected at 111 to the slotted end of a lever 112 fulcrumed at 113 and articulated with the intermediate part to a small actuating electromagnet 114 connected by suitable interface to the processor 115 which controls the functioning of the machine and to which the sensor 88 of station 8 is connected.

Figure 21:
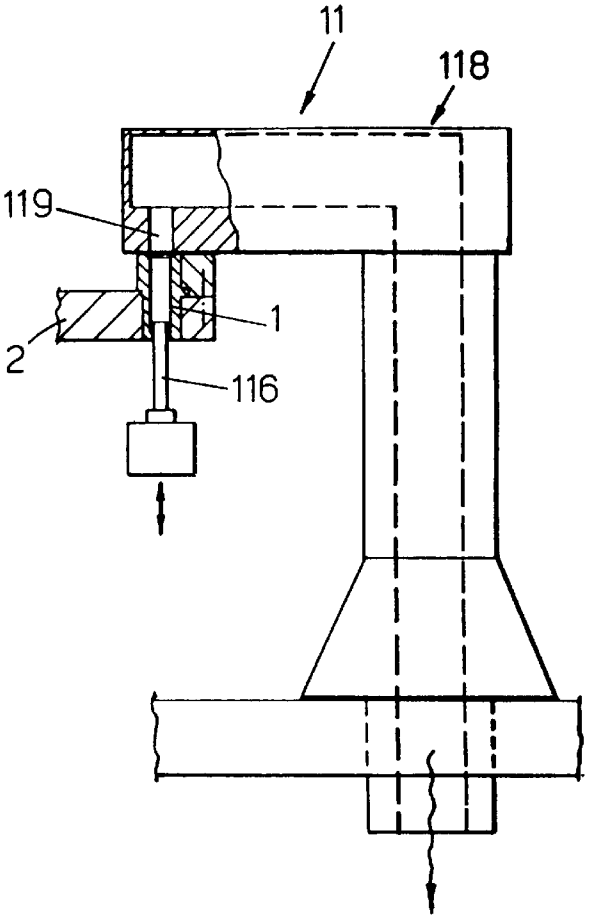
FIG. 21 illustrates laterally with parts in section and in the active condition the station for cleaning the bushes.

When discharge of the product from the bushes 1 has taken place and when the push rods 101 have been lowered, the turntable 2 rotates by one step and the bushes themselves arrive in station 11 in FIG. 21, in alignment with lower axially hollow push rods 116 which are connected to a source for delivering compressed air and mounted on means of axial movement. The same bushes 1 arrive with their upper end at a short distance from and in alignment with the openings 119 of a hollow head 118 connected at the bottom to a source of suction. On command, the push rods 116 are raised and lowered so as to pass completely through the bushes 1 while the head 118 sucks and removes any fragment which may be present in the bushes themselves which are thus ready to carry out a new work cycle.

We claim:

1. A machine for packaging tablets in gelatine capsules comprising:

groups of bushes, each said bush being capable of containing, superposed and in mutual axial alignment, a base cover orientated with a mouth thereof upwards, an oblong tablet, and a lid cover orientated with a mouth thereof downwards;

a moving means for positioning said groups of bushes in stepped movements at successive work stations, said groups of bushes being located on said moving means with a mutual equidistance therebetween;

a processor which controls a cyclic operation of said moving means and of said successive work stations; and said successive work stations comprising:

(a) a first insertion station including a first feeding magazine where a plurality of the base covers are located in bulk, and a first insertion means for taking base covers from said first feeding magazine and for inserting a respective base cover with the mouth thereof upwards in each respective said bush located in said first insertion station;

(b) a second insertion station including a second feeding magazine in which a plurality of the tablets are located in bulk, and a second insertion means for taking tablets from said second feeding magazine and for inserting a respective tablet above each respective base cover in each respective said bush located in said second insertion station;

(c) a third insertion station including a third feeding magazine where a plurality of the lid covers are located in bulk, and a third insertion means for taking lid covers from said third feeding magazine and for inserting a respective lid cover with the mouth thereof downwards in each respective said bush located in said third insertion station;

(d) a checking station which checks a correct or an incorrect presence in each of said bushes of said group of an assembly of the base cover, the tablet and the lid cover, and which sends an incorrect presence signal to said processor for each incorrect presence sensed;

(e) a compression station which subjects said assembly of the base cover, the tablet and the lid cover to an axial compression which causes the tablet to enter into the base and lid covers and to become enclosed thereby;

(f) an ejection station which ejects the compressed assembly from each said bush, said ejection station including a separating means for separating any compressed assembly from a respective said bush of said group which was signaled to said processor as being incorrect from a remainder of the compressed assemblies which are considered correctly compressed assemblies; and (g) a cleaning station which cleans said bushes of said group prior to introduction to said first feeding station in a new work cycle.

2. A machine for packaging tablets as claimed in claim 1;

wherein each said bush includes a top with a cut portion which is cut open radially and upwardly, said cut open portion being of a limited extent such that a lowermost portion of the lid cover inserted at said third insertion station is located below said cut portion and the lid cover is thus securely held in said bush; and wherein said third insertion means includes, for each said bush, a pusher which longitudinally pushes a respective lid cover into the respective said bush, said pusher having a front point which laterally engages the respective lid cover as said pusher pushes the respective lid cover such that said front point is received in a respective said cut portion as the lid cover is pushed in the respective said bush by said pusher.

3. A machine for packaging tablets as claimed in claim 1:

wherein said first insertion station includes (a) first flat horizontal ducts each having an intermediate part with a respective first vertical seat therein, (b) first vertical tubes, each said first vertical tube conveying base covers in a random axial orientation therealong from said first magazine to a first end of said first vertical tube, (c) a first moving means for moving said first ends of said first vertical tubes in a cyclical raising and lowering relative to a respective said first vertical seat, (d) a first opening and closing means for each said first vertical tube for opening said first end when said first vertical end is lowered and for closing said first end when said first vertical end is raised, and (e) a first suction hole for an intermediate portion of each vertical side of said first vertical seats, said first suction hole being selectively connected to a source of suction such that when a lowermost base cover is inserted into said first vertical seat by a lowering of said first end and an opening of said first end by said first opening and closing means, the lowermost base cover is retained in said first vertical seat by suction exerted at said first suction hole even if the lowermost base cover is nested with a next lowermost base cover in said first vertical tube as said first vertical tube is raised and said first end is closed; and wherein said third insertion station includes (a) second flat horizontal ducts each having an intermediate part with a respective second vertical seat therein, (b) second vertical tubes, each said second vertical tube conveying lid covers in a random axial orientation therealong from said second magazine to a second end of said second vertical tube, (c) a second moving means for moving said second ends of said second vertical tubes in a cyclical raising and lowering relative to a respective said second vertical seat, (d) a second opening and closing means for each said second vertical tube for opening said second end when said second vertical end is lowered and for closing said second end when said second vertical end is raised, and (e) a second suction hole for an intermediate portion of each vertical side of said second vertical seats, said second suction hole being selectively connected to a source of suction such that when a lowermost lid cover is inserted into said second vertical seat by a lowering of said second end and an opening of said second end by said second opening and closing means, the lowermost lid cover is retained in said second vertical seat by suction exerted at said second suction hole even if the lowermost lid cover is nested with a next lowermost lid cover in said second vertical tube as said second vertical tube is raised and said second end is closed.

4. A machine for packaging tablets as claimed in claim 3:

wherein each said first end of each said first vertical tube includes an endpiece which is oriented downwards and which is inserted into a respective intermediate part of each said first flat horizontal duct adjacent a respective said first vertical seat as the respective said first vertical tube is lowered in order to guide the base cover into the respective said first vertical seat; and wherein each said second end of each said second vertical tube includes an endpiece which is oriented downwards and which is inserted into a respective intermediate part of each said second flat horizontal duct adjacent a respective said second vertical seat as the respective said second vertical tube is lowered in order to guide the base cover into the respective said second vertical seat.

5. A machine for packaging tablets as claimed in claim 3:

wherein each said first vertical seat is formed by a first body having said first flat horizontal duct therethrough, each said first body including (a) a first lower part which defines a bottom of said first vertical seat and of said first flat horizontal duct, (b) first parallel parts mounted to said first lower part which define opposite vertical sides of said first vertical seat and of said first flat horizontal duct, one of said first parallel parts having said first suction hole therein and including a first vertical hole connected to said first suction hole and to the source of suction; and wherein each said second vertical seat is formed by a second body having a second horizontal flat horizontal duct therethrough, each said second body including (a) a second lower part which defines a bottom of said second vertical seat and of said second flat horizontal duct, (b) second parallel parts mounted to said second lower part which define opposite vertical sides of said second vertical seat and of said second flat horizontal duct, one of said second parallel parts having said second suction hole therein and including a second vertical hole connected to said second suction hole and to the source of suction.

6. A machine for packaging tablets as claimed in claim 3:

wherein each said first flat horizontal duct has a first upstream end and a first downstream end, said first downstream end extending partially into the respective said first vertical seat and being vertically lower than said first upstream end such that the lowering of said first downstream end facilitates rotation of a respective said base cover inserted in the associated said first vertical seat with a mouth thereof upwards; and wherein each said second flat horizontal duct has a second upstream end and a second downstream end, said second downstream end extending partially into the respective said second vertical seat and being vertically lower than said second upstream end such that the lowering of said second downstream end facilitates rotation of a respective said lid cover inserted in the associated said second vertical seat with a mouth thereof upwards.

7. A machine for packaging tablets as claimed in claim 6:

wherein each said first insertion station further includes for each first flat horizontal duct (a) a first flat pusher having a first front point such that when said first pusher is translated from the upstream end to the downstream end through the associated said first vertical seat with the base cover therein, said first front point engages an intermediate part of the base cover and rotates the base cover so that no matter whether the mouth of the base cover was up or down in said first vertical seat the mouth is oriented downstream when the base cover reaches a top part of said first descending vertical duct, and (b) a first vertical pusher located above the top part of said first descending vertical duct, said first vertical pusher including a first front face which moves downwardly to engages the base cover and cause the base cover to have the mouth thereof oriented upwards as the mouth cover is introduced vertically downwards into the associated said bush; and wherein each said third insertion station further includes for each second flat horizontal duct (a) a second flat pusher having a second front point such that when said second pusher is translated from the upstream end to the downstream end through the associated said second vertical seat with the lid cover therein, said second front point engages an intermediate part of the lid cover and rotates the lid cover so that no matter whether the mouth of the lid cover was up or down in said second vertical seat the mouth is oriented downstream when the lid cover reaches a top part of said second descending vertical duct, and (b) a second vertical pusher located above the top part of said second descending vertical duct, said second vertical pusher including a second front face which moves downwardly to engages the lid cover and cause the lid cover to have the mouth thereof oriented upwards as the mouth cover is introduced vertically downwards into the associated said bush.

8. A machine for packaging tablets as claimed in claim 7:

wherein each said first pusher also includes a first containing point located above said first front point, parallel to said first front point, and spaced from said first front point by a distance such that, when a base cover is oriented in said first vertical seat with the mouth thereof downwards and said first front point causes the mouth of the base cover to be rotated upwards to bring the mouth to be oriented in the downstream direction, the base cover is contained between said first front point and said first containing point during further downstream movement of said first pusher; and wherein each said second pusher also includes a second containing point located above said second front point, parallel to said second front point, and spaced from said second front point by a distance such that, when a lid cover is oriented in said second vertical seat with the mouth thereof downwards and said second front point causes the mouth of the lid cover to be rotated upwards to bring the mouth to be oriented in the downstream direction, the lid cover is contained between said second front point and said second containing point during further downstream movement of said second pusher.

9. A machine for packaging tablets as claimed in claim 3:

wherein said first insertion station further includes (a) for each said first vertical tubes, a first longitudinal slot therein, (b) a first support structure having a respective first blade sized to be inserted partially into a respective said first longitudinal slot, and (c) a first reciprocating means for moving said support reciprocally horizontally and thus to move said first blades into and out of said first longitudinal slots in order to subject the base covers in said first longitudinal slots to an aligning and fluidizing action and hence to enhance a gravitation sliding of the base covers in said first vertical tubes; and wherein said third insertion station further includes (a) for each said second vertical tubes, a second longitudinal slot therein, (b) a second support structure having a respective second blade sized to be inserted partially into a respective said second longitudinal slot, and (c) a second reciprocating means for moving said support reciprocally horizontally and thus to move said second blades into and out of said second longitudinal slots in order to subject the lid covers in said second longitudinal slots to an aligning and fluidizing action and hence to enhance a gravitation sliding of the lid covers in said second vertical tubes.

10. A machine for packaging tablets as claimed in claim 1, wherein said second insertion means includes:

a feed device including (a) a guide having a set of horizontally disposed longitudinal channels contoured for the receipt and conduction of tablets arranged longitudinally and one after another in a line in said longitudinal channels, (b) a release means for releasing tablets in said second feeding magazine and for feeding the released tablets into said longitudinal channels, (c) a respective set of curved and descending guides for said set of said longitudinal channels, (d) a vibration means for imparting a vibration to said set of said longitudinal channels to move the line of tablets along said longitudinal channels to said set of curved and descending guides, and (e) a respective set of vertical guide ducts for receipt of lines of said tablets conducted by said set of said curved and descending guides, said vertical guides ducts having guide lower ends located to one side of said bushes located in said second insertion station;

a distributor device including (a) a distributor drawer which is located below said lower ends of said vertical guide ducts, said distributor drawer including a respective set of vertical seats therein dimensioned for the horizontal containment of a respective tablet and an upper surface adjacent said vertical seats, (b) an obturator located below said distributor drawer from a position below said lower ends of said vertical guide ducts to a position horizontally adjacent said bushes, and (c) a horizontal translation means for moving said distributor drawer between (i) a receipt position where said vertical seats are aligned below said lower ends of said vertical guide ducts so that a single lowermost tablet is deposited by gravity in each respective said vertical seat and held vertically therein by said obturator and (ii) a release position where said vertical seats are aligned above respective said bushes so that the tablets in said vertical seats move beyond said obturator and fall into respective said bushes and where said upper surface holds the remaining tablets in said vertical guides ducts therein until said vertical seats are again aligned below said lower ends, a retaining means for each said vertical guide ducts for retaining a penultimate tablet vertically therein as said vertical seats are returned to the position where said vertical seats are aligned with said lower ends and a lowermost tablet falls from said lower end even if the lowermost tablet is only a portion of a complete tablet; and a pusher device including (a) for each said vertical seat, a pusher located above the respective said vertical seat when the respective said vertical seat is aligned with the respective said bush, and (b) a pusher moving means for moving each said pusher between (i) a position where each respective said pusher is located above the respective said vertical seat with the respective said tablet therein and (b) a position where each said pusher has traveled through the respective said vertical seat and assured the removal of the respective said tablet from the respective said vertical seat and further said pusher has pushed the respective said tablet partially into the respective said base cover in the respective said bush.

11. A machine for packaging tablets as claimed in claim 10:

wherein each said retaining means includes at least one hole which opens laterally in the respective said vertical guide duct and which is selectively connected to a source of suction; and wherein said processor connects each said hole to the source of suction to retain the associated tablet in the associated said vertical guide duct as said vertical seats are returned to the position where said vertical seats are aligned so that only the lowermost tablet falls into said vertical seats, and said processor also disconnects said holes from the source of suction after said drawer has moved from the receipt position by said horizontal translation means.

12. A machine for packaging tablets as claimed in claim 11, wherein each said retaining means includes an upper said hole and a lower said hole, said upper hole being located at a position midway along a length of the associated penultimate tablet where a full-length lowermost tablet is therebeneath and resting on said upper surface, and said lower hole being located at a position midway along a length of the associated penultimate tablet where a half-length lowermost tablet is therebeneath and resting on said upper surface.

13. A machine for packaging tablets as claimed in claim 11:

wherein each said vertical seat of said distributor has a height which is substantially equal to or slightly less than a length of the associated tablets; and wherein each said guide lower end of each said vertical guide duct has a recess facing said bushes to help avoid interference with the tablets when the tablets are located in said vertical seats of said distributor drawer and said distributor drawer is moved from the receipt position to the release position.

14. A machine for packaging tablets as claimed in claim 10:

wherein said obturator includes respective suction holes therein positioned immediately below respective said lower ends of said vertical guide ducts, each said suction hole being connected to a source of suction when said distributor is in the receipt position so that when the lowermost tablet falls therein the lowermost tablet is positively retained in the respective said vertical seat and does not rebound therefrom.

15. A machine for packaging tablets as claimed in claim 14, wherein said obturator includes a set of holding holes and a corresponding set of removable plugs for said holding holes, each said plug including a respective said suction hole therein and being removable vertically from beneath said obturator from an associated said holding hole to provide vertical access to the respective said vertical guide duct thereabove through the respective said holding hole.

16. A machine for packaging tablets as claimed in claim 1, wherein said checking station includes, for each said bush:

a movable push rod with an upper concave head;

a rod moving means for moving said push rod vertically upwards and into said bush to raise the assembly of the base cover, the tablet and the lid cover out of said bush by a predetermined travel;

a sprung push rod directly above said movable push rod and the assembly and which is engaged and moved upwards when the assembly is raised by the predetermined travel; and a sensor connected to said processor which senses whether said sprung push rod is moved upwards sufficiently as said movable push rod is moved by said rod moving means and which signals to said processor when said push rod is not moved upwards sufficiently as this signifies that at least one of a complete base cover, tablet or lid cover is missing from the associated assembly and hence that the associated assembly is incorrect and is to be separated at said ejection station.

17. A machine for packaging tablets as claimed in claim 1, wherein said compression station includes, for each said bush:

a movable push rod with an upper concave head;

a rod moving means for moving said push rod vertically upwards and into said bush to raise the assembly of the base cover, the tablet and the lid cover out of said bush by a predetermined distance; and a sprung push rod with a lower concave head directly above said movable push rod and the assembly and which said concave head is engaged when the assembly is raised by the predetermined amount, said sprung push rod including an adjustable force exerting element which exerts a downward force on said lower concave head sufficient to cause the enclosure of the tablet by the base and lid covers as said movable push rod is moved by the predetermined distance.

18. A machine for packaging tablets as claimed in claim 1, wherein said ejection station includes, for each said bush:

a movable push rod;

a rod moving means for moving said push rod vertically upwards and into said bush to raise the compressed assembly of the base cover, the tablet and the lid cover out a top of said bush;

an inclined and descending duct located adjacent the top of said bush and having a lower end where correct compressed assemblies are collected and an outlet opening above said lower end;

a nozzle adjacent the top of said bush which delivers a jet of air to the compressed assembly pushed out of the top of said bush to push the compressed assembly onto said descending duct;

a trap door which normally covers said outlet opening; and a trap door moving means for moving said trap door temporarily away from said outlet opening when said checking station has indicated that the associated assembly is incorrect so that the incorrect assembly travels down said descending duct and into said outlet opening for disposal.

19. A machine for packaging tablets as claimed in claim 1, wherein said cleaning station includes, for each said bush:

a movable, axially hollow push rod which is connected to a source of compressed air;

a rod moving means for moving said push rod vertically upwards and through said bush as compressed air is emitted from said push rod; and a head with a mouth connected to a source of suction, said mouth being located immediately above said bush so that any material blown out of said bush by said push rod is drawn into said mouth.

* * * * *